US008052165B2

(12) United States Patent
Holzer

(10) Patent No.: US 8,052,165 B2
(45) Date of Patent: Nov. 8, 2011

(54) END PIECE FOR THE FRONT OR REAR END OF A SKI OR SNOWBOARD AND A SKI FITTED THEREWITH OR A SNOWBOARD FITTED THEREWITH

(75) Inventor: Helmut Holzer, St. Johann (AT)

(73) Assignee: Atomic Austria GmbH (AT)

( * ) Notice: Subject to any disclaimer, the term of this patent is extended or adjusted under 35 U.S.C. 154(b) by 233 days.

(21) Appl. No.: 12/339,207

(22) Filed: Dec. 19, 2008

(65) Prior Publication Data

US 2009/0261544 A1 Oct. 22, 2009

(30) Foreign Application Priority Data

Dec. 21, 2007 (AT) ..... A 2104/2007

(51) Int. Cl.
*A63C 5/06* (2006.01)

(52) U.S. Cl. ..... 280/608; 280/809

(58) Field of Classification Search ..... 280/601, 280/602, 603, 607, 608, 609, 610, 613, 614, 280/633, 634, 809, 842, 845, 14.1, 14.21, 280/15, 22, 28.16

See application file for complete search history.

(56) References Cited

U.S. PATENT DOCUMENTS 2,367,271 A * 1/1945 Habostad ..... 280/14.1
3,326,564 A * 6/1967 Heuvel ..... 280/602
3,534,972 A * 10/1970 Salerno ..... 280/609
3,549,162 A * 12/1970 Coutts ..... 280/602
3,567,239 A 3/1971 Kitterman
3,703,299 A * 11/1972 Kutchma ..... 280/818
3,820,802 A * 6/1974 Davis ..... 280/601

(Continued)

FOREIGN PATENT DOCUMENTS

DE 2704858 8/1978

(Continued)

OTHER PUBLICATIONS

Office Action corresponding to priority Austrian Application No. A 2104/2007, dated Jun. 10, 2008, 3 pages.

*Primary Examiner* — J. Allen Shriver, II
*Assistant Examiner* — Brodie Follman
(74) *Attorney, Agent, or Firm* — Lerner, David, Littenberg, Krumholz & Mentlik, LLP

(57) ABSTRACT

The invention relates to an end piece (2, 2') for the front or rear end of a ski (1) or snowboard, which end piece (2, 2') has at least a first and a second portion (6, 7). A distance (10, 10') between mutually adjacent zones (8, 9) of the first and second portion (6, 7) or a width or length measurement of at least one of the zones (8, 9) can be varied. Alternatively, the first and second portion (6, 7) are connected to one another in the mutually adjacent zones (8, 9) by means of an articulated joint and/or an elastically stretchable and rebounding bridging element and/or an elastically deformable middle portion (12) and the zones of the first and second portion (6, 7) remote from the mutually adjacent zones (8, 9) can be respectively connected to oppositely lying side edges of a ski (1) or snowboard by articulated joints and/or with an interconnected elastic deformation zone. This positively influences the performance of a ski (1) or snowboard with a variable geometry or size.

38 Claims, 8 Drawing Sheets

U.S. PATENT DOCUMENTS

| | | | | | |
|---|---|---|---|---|---|
| 3,921,994 | A | * | 11/1975 | Locati | 280/607 |
| 4,071,264 | A | * | 1/1978 | Legrand et al. | 280/610 |
| 4,180,275 | A | * | 12/1979 | Montoya | 280/601 |
| 4,211,433 | A | * | 7/1980 | Pedersen | 280/601 |
| 4,275,904 | A | * | 6/1981 | Pedersen | 280/818 |
| 4,340,241 | A | * | 7/1982 | Crocket | 280/609 |
| 4,509,771 | A | * | 4/1985 | Nussbaumer | 280/609 |
| 4,616,842 | A | * | 10/1986 | Echevin et al. | 280/602 |
| 4,828,288 | A | * | 5/1989 | Humbert | 280/818 |
| 4,951,960 | A | * | 8/1990 | Sadler | 280/607 |
| 4,981,455 | A | * | 1/1991 | Tubens | 441/73 |
| 5,292,146 | A | * | 3/1994 | Palau | 280/601 |
| 5,299,822 | A | * | 4/1994 | Mayr et al. | 280/610 |
| 5,310,221 | A | * | 5/1994 | Schmidt | 280/809 |
| 5,360,228 | A | * | 11/1994 | Palau | 280/609 |
| 5,435,589 | A | * | 7/1995 | Fagot | 280/610 |
| 5,551,728 | A | * | 9/1996 | Barthel et al. | 280/818 |
| 5,558,354 | A | * | 9/1996 | Lion | 280/607 |
| 5,649,722 | A | * | 7/1997 | Champlin | 280/818 |
| 5,785,342 | A | * | 7/1998 | Bronson | 280/602 |
| 5,984,324 | A | * | 11/1999 | Wariakois | 280/14.24 |
| 6,000,711 | A | * | 12/1999 | Fey et al. | 280/603 |
| 6,082,747 | A | * | 7/2000 | Parmentier | 280/14.22 |
| 6,345,455 | B1 | * | 2/2002 | Greer et al. | 36/155 |
| 6,393,736 | B1 | * | 5/2002 | Greer et al. | 36/155 |
| 6,523,851 | B1 | * | 2/2003 | Maravetz | 280/603 |
| 6,682,083 | B2 | * | 1/2004 | Melcher | 280/14.26 |
| 6,945,563 | B2 | * | 9/2005 | Clausing | 280/809 |
| 7,014,206 | B2 | * | 3/2006 | Donze | 280/602 |
| 7,052,044 | B1 | * | 5/2006 | Streeter | 280/818 |
| 7,213,828 | B2 | * | 5/2007 | Riepler et al. | 280/609 |
| 7,258,360 | B2 | * | 8/2007 | Vallet et al. | 280/609 |
| 7,344,148 | B2 | * | 3/2008 | Donze et al. | 280/602 |
| 7,393,255 | B1 | * | 7/2008 | Wilhelmi | 441/65 |
| 7,484,738 | B2 | * | 2/2009 | Belt | 280/14.26 |
| 2003/0173769 | A1 | | 9/2003 | Clausing | |
| 2004/0119264 | A1 | * | 6/2004 | Vallet et al. | 280/602 |
| 2005/0269801 | A1 | * | 12/2005 | Carlson et al. | 280/609 |
| 2007/0267847 | A1 | * | 11/2007 | Carlson et al. | 280/609 |
| 2007/0296181 | A1 | * | 12/2007 | Alary et al. | 280/601 |
| 2008/0073875 | A1 | * | 3/2008 | Krafft | 280/601 |
| 2009/0011667 | A1 | * | 1/2009 | Hayward et al. | 441/74 |
| 2010/0171288 | A1 | * | 7/2010 | Nicosia et al. | 280/609 |
| 2010/0187795 | A1 | * | 7/2010 | Binder | 280/601 |

FOREIGN PATENT DOCUMENTS

| | | | | |
|---|---|---|---|---|
| DE | 20101963 | U1 | | 9/2001 |
| EP | 1334752 | A2 | | 8/2003 |
| FR | 2794374 | A1 | * | 12/2000 |

* cited by examiner

END PIECE FOR THE FRONT OR REAR END OF A SKI OR SNOWBOARD AND A SKI FITTED THEREWITH OR A SNOWBOARD FITTED THEREWITH

In accordance with 35 U.S.C. §119, the applicants claim the priority of Austrian patent application No. A 2104/2007 dated 21 Dec. 2007.

BACKGROUND OF THE INVENTION

1. Field of the Invention

The invention relates to an end piece for the front or rear end of a ski or snowboard as well as a co-operating ski or a snowboard equipped therewith, as specified in claims 1, 2 and 35.

2. Prior Art

End pieces or terminating elements for the front or rear end of skis or snowboards are known in principal from the prior art. These end pieces primarily fulfill the function of a cladding element for the tip or end portion of the corresponding gliding board body. For reasons pertaining to the production technology used, such end pieces are mostly fitted in the tip or end portion of a ski or snowboard in particular. These end pieces specifically provide a visually advantageous termination for the gliding board body. Especially if the gliding board body is made from a multi-layered composite body and is manufactured by a foam injection process, a known approach is to provide the end portions of the gliding board body with an end piece serving as a cladding element. This being the case, these end pieces may be adhered to the gliding board body during the production process already and/or secured to the end portion of the gliding board body by a positive connection or by means of fixing screws. These end pieces are therefore of fixed dimensions, adapted to the dimensions of the respective ski or snowboard. No provision is made for a variable width or thickness.

Document DE 202 01 963 U1 discloses an extension for the tip or shovel which can be fitted as and when necessary. This tip extension can be pushed onto the ski tip when necessary to enable skiing in deep snow. This push-on tip, which is primarily intended to impart greater buoyancy when moving on deep snow, can then be removed again by the user. This tip extension is therefore an accessory which can be fitted and removed as and when required and can be fitted on a plurality of skis with different shovel geometries. In particular, provision is made so that this fitting fits different dimensions of the front end of the skis, in particular the shovels, depending on manufacturer and ski model. To this end, the fitting is of an essentially U-shaped design as seen from above, and the distance between the two legs of the U-shaped fitting may be made bigger or smaller in order to adapt to the respective shovel widths of different ski models.

OBJECTIVES AND ADVANTAGES OF THE INVENTION

The underlying objective of this invention is to propose an end piece for the front or rear end of a ski or snowboard, by means of which the performance, in particular the control behavior of a ski or snowboard, can be improved, in particular of a ski or snowboard with variable geometry or sizing. Another objective is to specify a co-operating ski or a co-operating snowboard.

The first objective of the invention is achieved on the basis of an end piece as defined in claim 1 or 2. The advantage of this is that an end piece of this type improves the control behavior of a ski or snowboard on which it is fitted. In particular, the stability of the end portion of the ski or snowboard, which is variable in terms of the cross-sectional geometry or size, can be positively influenced. By means of the end piece proposed by the invention, it is possible to ensure that the intended cross-sectional variability is either totally unimpeded or barely impeded at all, whilst at the same time providing mutual support between the side edges of a ski or snowboard, which are uncoupled to a relatively high degree in terms of force. In particular, the end piece proposed by the invention constitutes a binding member between the side portions of the gliding board body lying to the left and right of the longitudinal mid-axis, thereby enabling the control behavior, in particular cornering stability, of a corresponding ski or snowboard to be significantly improved by means of the end piece. This end piece therefore has a multiple function in that it improves travel properties on the one hand and also increases the robustness of the ski or snowboard with variable geometry.

As a result of the features defined in claim 3, the end pieces can be connected to the respective end portion of a gliding board body so that they are particularly resistant to tearing off because the side portions of the end pieces can be rigidly and non-releasably connected to a gliding board body, whereas the middle portion of the end pieces assures the requisite relative adjustability.

The embodiment defined in claim 4 ensures that a snow gliding board which is variable in terms of its shovel geometry or the geometry of the side edges, in particular a ski or snowboard, is not obstructed in its positioning movements or is so as little as possible.

The advantage of the embodiment defined in claim 5 is that the side portions or legs of the essentially U-shaped or sickle-shaped end pieces can be fixedly or rigidly connected to the gliding board body, whereas the desired relative displaceability takes place starting from the middle portion or from the base portion of the U-shaped or sickle-shaped end pieces. In particular, instead of opening out the side portions of the end pieces, a variation in distance is achieved starting from the base of the U-shaped or sickle-shaped end pieces.

Another advantageous embodiment defined in claim 6 ensures that the gliding faces or control edges of the ski or snowboard to the side of the longitudinal axis remain as far as possible constantly in a common plane. The common plane extends essentially parallel with the gliding face of the gliding board body. In particular, this prevents a height offset from occurring between individual gliding board tongues or gliding board part-portions in the front or rear end portion of the gliding board body during so-called "carving" or when traveling on the edge. The control or cornering behavior of a gliding board body that is fully or partially slotted in the longitudinal direction can therefore be significantly improved by the specified end piece, which simultaneously serves as a guide element.

As a result of the embodiment defined in claim 7, instead of a relative displaceability between two or more elements, use is made of an ability of the middle portion to stretch and rebound elastically so that the end piece can be adapted to varying widths due to an elastic deformability.

The embodiment defined in claim 8 results in an end piece based on a structurally compact design, and such an end piece is unlikely to be blocked due to snow or ice during its compensating movements or as the width varies.

As a result of the feature defined in claim 9, the end piece can be manufactured relatively inexpensively. Furthermore, warehouse management is simplified because only a single component is needed to form the front or rear end pieces of a ski or snowboard.

The advantage of the embodiment defined in claim 10 is that the end piece is made from relatively hard material at its side portions or along its legs and can therefore be fitted on a co-operating gliding board body in a particularly practical arrangement. The middle portion, on the other hand, is made from elastomeric or flexible plastic and thus ensures that the distance inside the base portion of the U-shaped or sickle-shaped end piece can be varied.

The advantage of the embodiment defined in claim 11 is that the end piece may be assembled as inexpensively as possible and also remains functionally reliable for a long time.

The features defined in claim 12 also permit a variation in the width of the end piece without causing a relative displacement between structurally independent elements. This avoids any gliding faces which might be susceptible to icing and correct functioning is guaranteed even under the worst usage conditions. Furthermore, a high maximum adjustment width can be achieved by means of an elasticity induced by a shape and type of material, for example in the form of an expandable folded arrangement, without the middle portion of the end piece being exposed to high stress or tearing forces. In particular, there are also no concerns with regard to material fatigue, even after numerous motion cycles.

The embodiment defined in claim 13 results in a weight-optimized design. It also affords extra personal protection because the tip or end region of the gliding board body is designed so that it is as blunt or rounded as possible.

The embodiment defined in claim 14 offers additional personal protection because the front end of the gliding board body is thicker and/or relatively flexible and/or designed with rounded edges. This also offers a durable protective feature which requires no particular maintenance or adaptation on the part of the end user.

The embodiment defined in claim 15 ensures that an end portion of a ski or snowboard which can be varied in geometry or cross-section has a visually attractive termination. The risk of the multi-layered structure of the respective gliding board body delaminating is also reduced.

As a result of the features defined in claim 16, the respective portions of the end pieces can be rigidly connected to the gliding board tongues of the gliding board body and are thus relatively resistant to tearing off. Furthermore, the variation in terms of plane or width or the variation between the side portions of the end pieces can be changed by means of the middle portion of the end piece.

As a result of another advantageous embodiment defined in claim 17, the end piece has a resilient elastic rebounding means which tends to always move back into a defined initial or non-operating position as soon as externally acting forces are removed. This active, resiliently elastic rebounding movement is conducive to the travel behavior of a ski or snowboard fitted with an end piece of this type. In a particularly advantageous manner, this elastically stretchable and rebounding bridging element may also service as a guide mechanism for preventing vertical deviating movements between the gliding board tongues of a split or longitudinally slotted ski or snowboard.

The features defined in claim 18 result in an end piece which is capable of fulfilling the intended function during the average period of usage of a ski or snowboard fitted with it. An end piece of this type also offers a sufficient amount of adjustment path so that the end piece does not obstruct the shovel or end region of a gliding board body which can be manually pre-set and/or which can vary in width due to stress or flexing.

Also of advantage is an embodiment defined in claim 19, because it is simply and effectively able to prevent a drop below a minimum distance between the two gliding board tongues of a gliding board body slotted in the longitudinal direction. In particular, it ensures that even in the event of strong forces between two gliding board tongues pushing them closer together, such as occur when traveling on one of the lateral control edges for example, a defined minimum distance is guaranteed between the gliding board tongues.

Based on the embodiment defined in claim 20, a stop element is provided, which simultaneously serves as a barrier element or a protective element for an expandable bridging element optionally disposed inside the gap. This projection specifically assumes a protective function for the flexible or rubber-like bridging element, which bridges the gap between the first and second gliding board tongue of a gliding board body. The robustness of a ski or snowboard with a geometry or size which can be varied can be enhanced still further.

The embodiment defined in claim 21 avoids increased fatigue of the elastically stretchable and rebounding bridging element over time, at least to a certain extent.

The features defined in claim 22 result in a robust end piece which can be connected to the to the respective end portion of the gliding board body particularly reliably and so that it will not tear off if the end piece is of a structurally slim or structurally relatively compact design.

An embodiment defined in claim 23 is of particular advantage because a central element or middle part is incorporated, which always remains centrally positioned. As a result, the middle part is always retained in an unchanged relative position with respect to a gliding board body, whilst the side portions of the end pieces can be moved relative to the central middle part. This ensures that the two side portions of the end pieces can be moved apart from one another and back towards one another starting from a middle part disposed in a defined position.

As a result of the embodiment defined in claim 24, middle parts of different types can be selectively positioned on the bridging element. In particular, this offers an easy way of fitting easily mounted and interchangeable middle parts with a guiding function and/or middle parts with a damping function between the two side portions of the end pieces.

The embodiment defined in claim 25 ensures that the middle part is centrally retained when the side portions of the end piece are moved in the direction towards the middle part or away from the middle part.

The features defined in claim 26 result in a stable retaining system for the middle part on the elastically stretchable and rebounding bridging element that is resistant to tearing off.

As a result of the features defined in claim 27, undesired relative movements between the first and second portion of the end pieces can be reliably prevented. In particular, deviating movements between the first and second portion by reference to a direction extending vertically with respect to the bottom and top face of the end piece can be suppressed.

The features defined in claim 28 result in a spring element which is very robust and of a simple construction. Furthermore, the requisite adjustment widths can be achieved without the need for structurally complex or structurally bulky helical springs.

An embodiment defined in claim 29 is also of advantage because an end piece can be produced which is as lightweight and inexpensive as possible.

The embodiment defined in claim 30 is of advantage because a spring element of this type is particularly robust and is also able to assume an exact guiding function in order to prevent undesired relative movements between the portions of the end pieces.

As a result of the features defined in claim 31, the elastically stretchable and rebounding bridging element fulfils a dual function, thereby reducing the number of components needed and keeping the weight of the end piece low.

The embodiment defined in claim 32 prevents a gap from forming in the middle portion of the end piece. This prevents any mutual jamming or trapping of foreign bodies or ice build-up between the mutually moving portions of the end piece.

As a result of the features defined in claim 33, the shovel or end portion of the gliding board body can be opened out or closed without the end piece opposing such controlled movements, which can be manually pre-set and/or are induced by flexing but controlled due to a blocking or preventing resistance.

The advantage of the feature defined in claim 34 is that a robust, but structurally simple guide mechanism is provided, which is conducive to the guiding or control behavior of a ski or snowboard fitted with such an end piece. Furthermore, with an embodiment of this type, the tip or base region of the U-shaped or sickle-shaped end piece can be closed or bridged so that the gap or optionally a folded element bridging this gap can be better protected against damage. In particular, this reduces the probability of or avoids the risk of hard foreign bodies or clumps of ice or similar getting into the gap between the two gliding board tongues from the front end portion of the gliding board body.

Independently of the above, the objective of the invention is also achieved by means of a ski or a snowboard as defined in claim 35. The advantages and technical effects which can be achieved as a result may be found in the parts of the description given above. Another advantage is the fact that a gliding board body of this type affords better personal protection because the tip and end portions are at least partially clad or covered by means of the end piece.

An extraordinary and interesting travel behavior of the gliding board body is achieved if it has a geometry-influencing means for varying the cross-sectional geometry or changing the size, as specified in claim 36.

Also of advantage is an embodiment defined in claim 37 because a ski or snowboard is provided, the size or cross-sectional geometry of which can be changed in a particularly simple but nevertheless effective manner. Furthermore, the geometry of a ski or snowboard of this type can be influenced to a sufficiently significant degree with relatively low adjusting forces.

Finally, an embodiment as defined in claim 38 is of advantage because the gliding behavior or suitability of the gliding board body for the piste can be significantly improved.

BRIEF DESCRIPTION OF THE DRAWINGS

The invention will be explained in more detail below with reference to examples of embodiments illustrated in the appended drawings. The drawings provide a simplified, highly schematic illustration of the following.

DETAILED DESCRIPTION OF PREFERRED EMBODIMENTS

Figure 1:
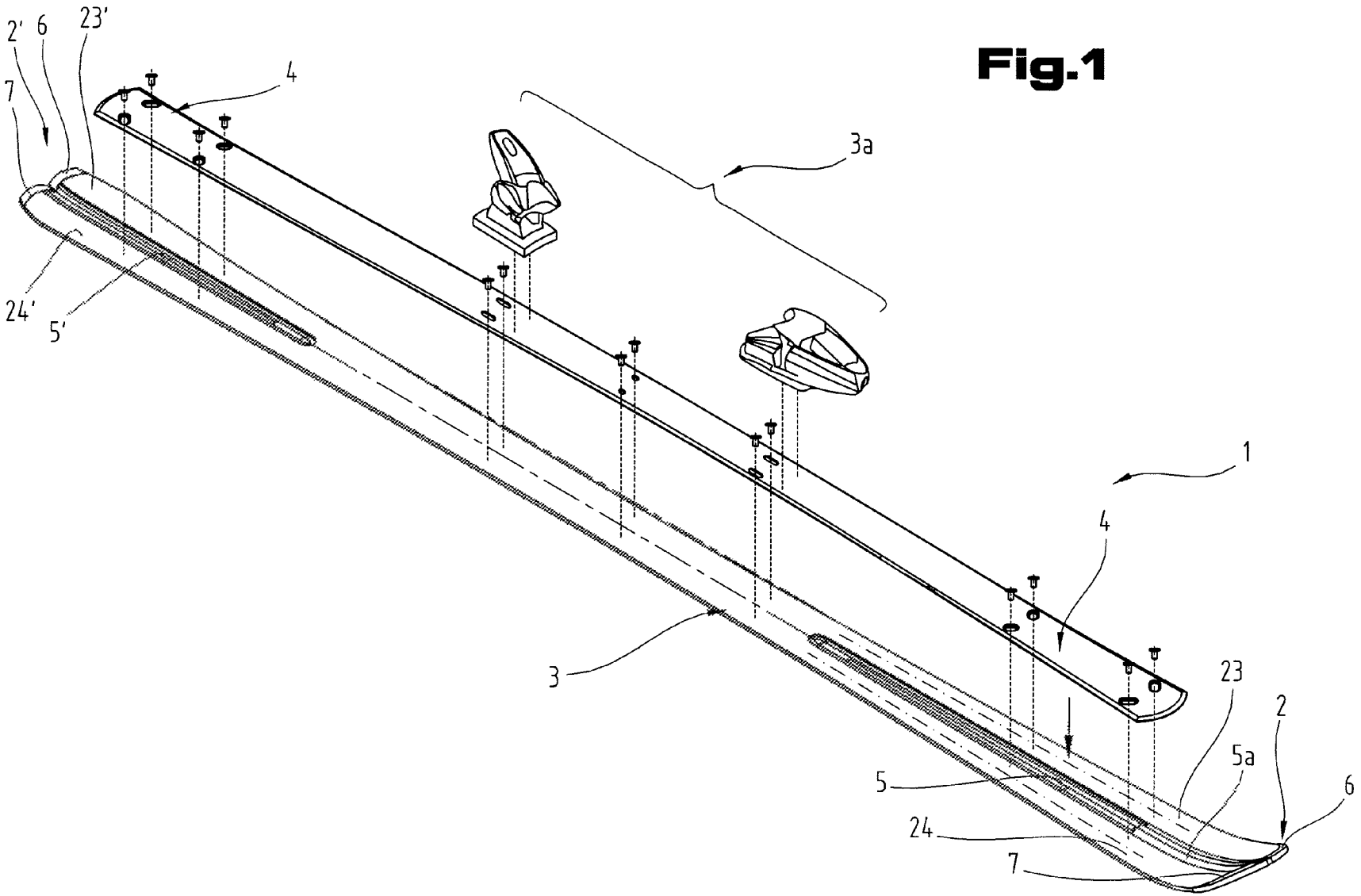
FIG. 1 is a perspective, exploded diagram illustrating an embodiment of a gliding board body, in particular a ski with a variable cross-sectional geometry or size in conjunction with an end piece proposed by the invention for the front and rear end of the gliding board body respectively.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
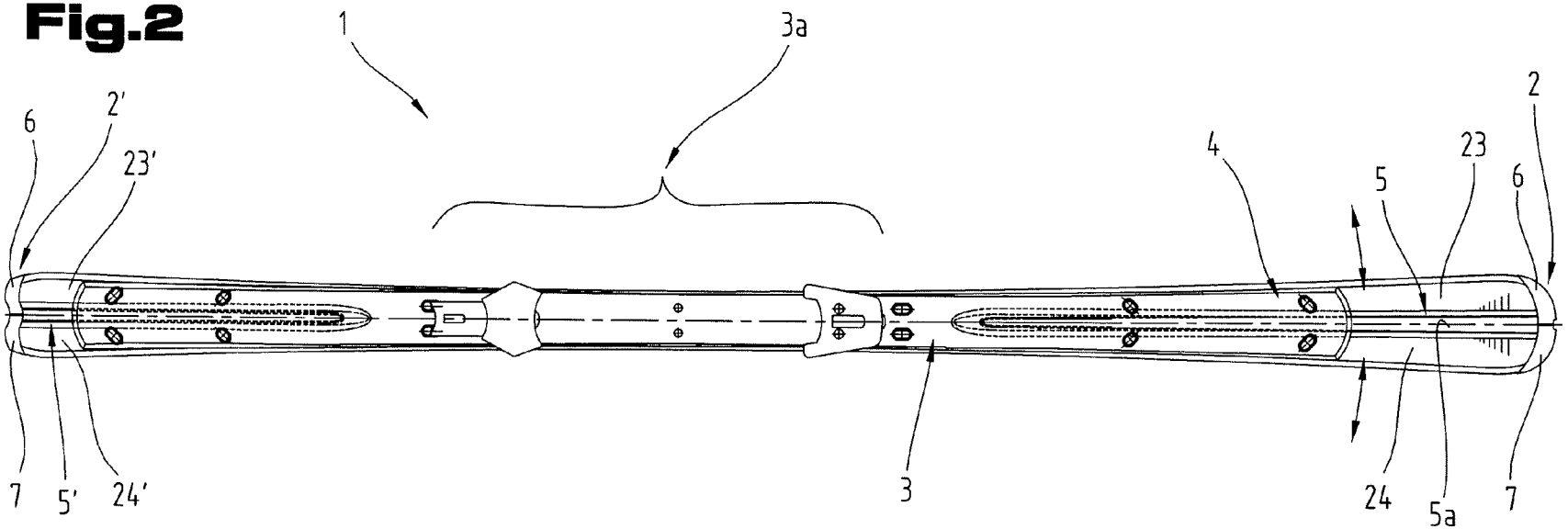
FIG. 2 is a plan view of the gliding board body illustrated in FIG. 1 in conjunction with end pieces proposed by the invention in the tip and end region of the gliding board body.

FIGS. 1 and 2 illustrate a ski 1, which has a technically improved end piece 2, 2' in the front and/or in the rear end portion. This end piece 2, 2' may naturally also be used on the front and/or on the rear end of some other gliding board body, in particular on a snowboard, a mono-ski or a similar snow gliding board.

The end piece 2, 2' proposed by the invention is primarily designed for skis or snowboards which have at least one geometry-influencing means 4 for changing the width or size and/or cross-sectional geometry of the front and/or rear end portion of the gliding board body 3. This geometry-influencing means 4 on the gliding board body 3 preferably comprises at least one slot, gap 5, 5' or some other weakening or split in the cross-section of the gliding board body 3. This cross-sectional weakening, which is be provided in the form of a slot or gap 5, 5' in the embodiment illustrated as an example, extends in the longitudinal direction of the gliding board body 3. It is provided either in the form of a weakening of the cross-section of the gliding board body 3 based on a plurality of mutually aligned orifices or slots or alternatively by a partial slit and extends from at least one end of the gliding board body 3 in the direction towards the middle portion of the gliding board body 3. It is preferable if both the front end portion and the rear end portion of the gliding board body 3 are slotted, in which case these cross-sectional weakened areas extend from the two ends, each in the direction towards the middle portion of the gliding board body 3. These cross-sectional weakened areas each expediently terminate at a predefined distance from the mounting portion for a binding mechanism 3*a* which is coupled with the foot of a user as and when necessary.

The essential aspect is that the end pieces 2, 2' described in detail below may be used with skis 1 or snowboards, the width of which in the shovel region and/or in the rear end region is variable depending on load and/or can be individually pre-adjusted by a user. As regards the technical design options for this gliding board body 3 with a variable geometry or size and as regards the technical design options of the geometry-influencing means 4, reference may be made to the detailed disclosures of Austrian patent applications A 173/2007 and A 174/2007 filed by this applicant and included herein as part of the subject matter of this disclosure. Also included in the subject matter of this disclosure is the disclosure of EP 1 297 869 B1.

The end pieces 2, 2' described below are therefore specifically designed for designs of skis 1 or snowboards which have a variable geometry, whereby a change is brought about in the width of the front and/or rear end portion by at least one longitudinally extending cut or slot in the front and/or rear end portion of the gliding board body 3. The end piece 2, 2' is therefore designed so that the changes in the width of the respective end portion of the gliding board body 3 can be varied as a function of load and/or can be pre-set individually by the user and at the same time have a positive effect on the performance which can be achieved with such a ski or snowboard, in particular its travel or control behavior. The end pieces 2, 2' may essentially help to increase the torsional stiffness of the front and/or rear end portion of the gliding board body 3, thereby having a positive effect on its travel or control behavior. Particularly in the case of a design based on slots or gaps 5, 5' in the gliding board body 3, the end pieces 2, 2' may function as a load-transferring coupling or stabilizing element between the individual tongues or legs in the front and/or rear end portion of the gliding board body 3. In other words, the torsional stiffness of adjacent gliding board tongues 23, 24 respectively 23', 24' of the front and/or rear end portion of the gliding board body 3 can be significantly increased by the end pieces 2, 2'. This in turn results in a more exact controllability and in improved cornering behavior of the gliding board body 3.

Figure 2A:
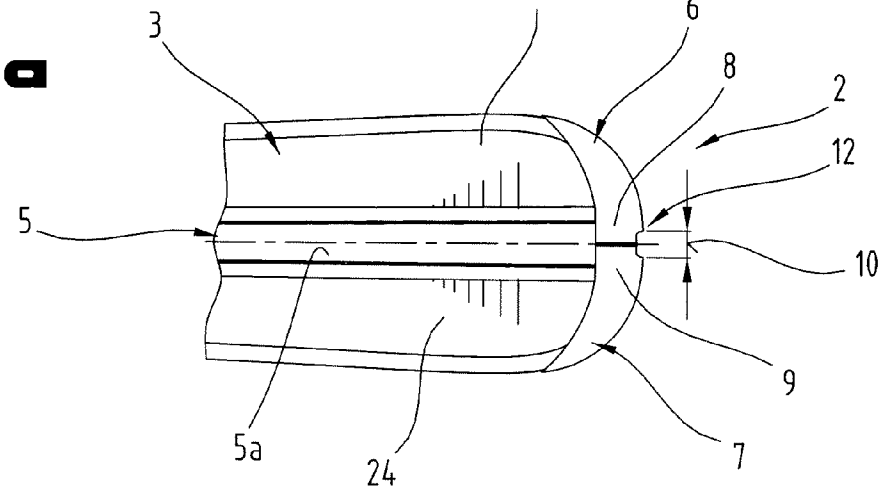
FIG. 2*a* is a plan view on an enlarged scale showing the front end portion of the gliding board body illustrated in FIG. 2.

As may best be seen from the enlarged diagram illustrated in FIG. 2*a*, the at least one slot or gap 5, 5' in the gliding board body 3 is preferably bridged by at least one flexible bridging element 5*a*. This flexible bridging element 5*a* is designed so that it can conform to the variations which occur in the geometry or distance in the respective end portion of the gliding board body 3 and prevent any snow or ice from passing from the bottom face of the gliding board body 3 in the direction towards the top face of the gliding board body 3. More technical details about the design may be found in Austrian patent application A 173/2007 filed by this applicant, which application is included in the subject matter of this disclosure.

In order to satisfy the above-mentioned requirements, the end piece 2, 2' has at least a first and a second portion 6, 7, and the position or relative position of the first portion 6 with respect to the position of the second portion 7 can be varied. The end pieces 2, 2' may be of a one-part design, i.e. made as a single part or element, which forms the two side portions 6, 7. However, the end pieces 2, 2' may also be of a multi-part design, in which case the individual portions 6, 7 are joined to form a single piece. Both embodiments, i.e. the single-part design and the multi-part design joined to form a single piece, will be described in more detail below. In principle, the first and second portion 6, 7 could also each constitute separate end or terminating parts, structurally independent of one another, for the at least two tongues or legs in the front and/or rear end portion of the gliding board body 3.

Figure 7:
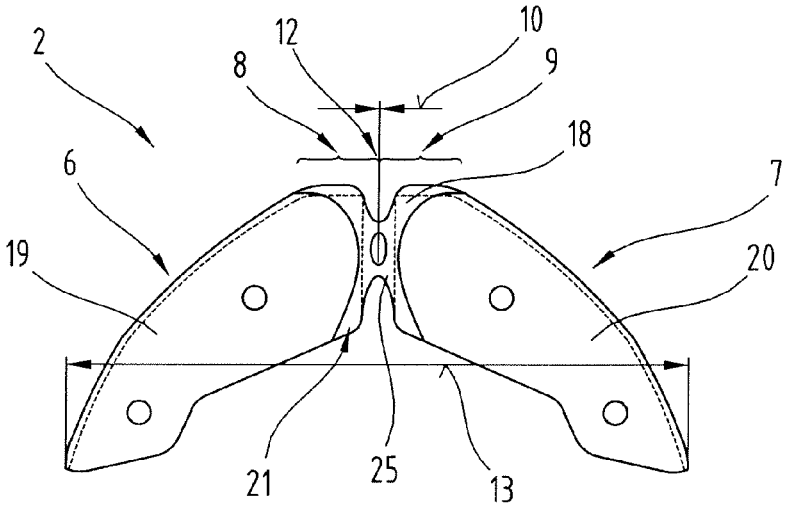
FIG. 7 illustrates an embodiment of an end piece made from a single part.

The first side portion 6 of the end pieces 2, 2' has a zone 8 which lies next to or is adjacent to the second side portion 7 of the end pieces 2, 2'. The second portion 7 of the end pieces 2, 2' has a zone 9 which lies next to the first portion 6 and is directly adjacent to the first portion 6. The mutually facing zones 8, 9 of the portions 6, 7 may be structurally separate portions 6, 7 or alternatively may be disposed on a single-part end piece 2, 2' with a continuous or uninterrupted transition portion between the zones 8, 9, as illustrated in FIG. 7 for example. The essential aspect is that a distance 10, 10' between the mutually adjacent zones 8, 9 of the first and second portion 6, 7 can be varied. In other words, the end piece 2, 2' is variable in terms of its width because the zones 8, 9 of the portions 6, 7 are elastically flexible in the case of a first embodiment, so that a width or length of at least one of the zones 8, 9 can be changed. In the case of another embodiment, the zones 8, 9 of the portions 6, 7 move telescopically one inside the other or the portions 6, 7 mutually overlap. Accordingly, the first and second portion 6, 7 preferably form a complementary guide mechanism 11, the guiding direction of which extends transversely to the longitudinal mid-axis and essentially parallel with the gliding face of the gliding board body 3.

This adjustment path between the first and second portion 6, 7 of the end pieces 2, 2' corresponding to the distance 10, 10' is preferably disposed in the middle portion 12 between the outer ends of the end pieces 2, 2'. This adjustment path or variable distance 10, 10' between the mutually adjacent zones 8, 9 is selected so that a prizing open or increase in width and a narrowing or reduction in width of the outer ends of the gliding board body 3 are able to influence the control behavior of the gliding board body 3' to a positive or perceptible degree. In particular, the end piece 2, 2' is designed so that the distance 10, 10' between the mutually adjacent zones 8, 9 is variable depending on a varying width of the front and rear end of the ski 1 or snowboard during travel or during use, as may be seen in particular from comparing FIGS. 3, 4. In other words, the end piece 2, 2' is designed so that its length or width varies between the first and second portion 6, 7, preferably starting from its middle portion 12. This means that an end piece 2, 2' that is essentially U-shaped or sickle-shaped as seen in plan view varies in terms of its width 13 via a telescopic, elastically flexible and/or hinge-mounted middle portion 12, as will be explained in more detail below.

Figure 3:
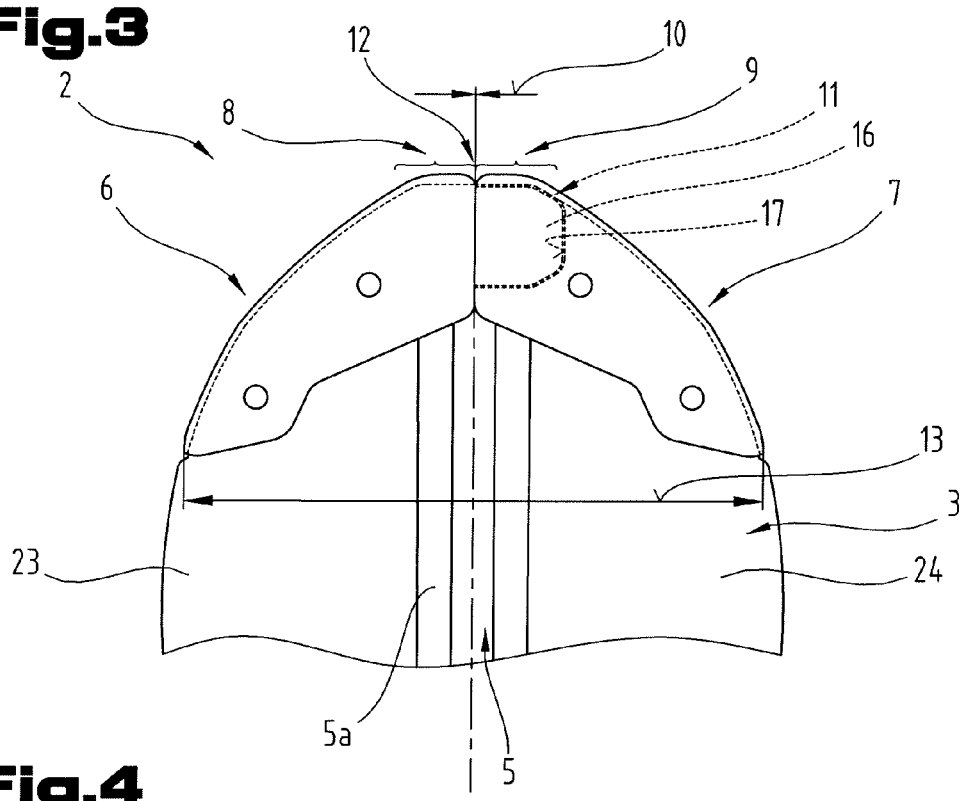
FIG. 3 is a plan view showing a first embodiment of the end piece proposed by the invention for the shovel region of a ski.
Figure 4:
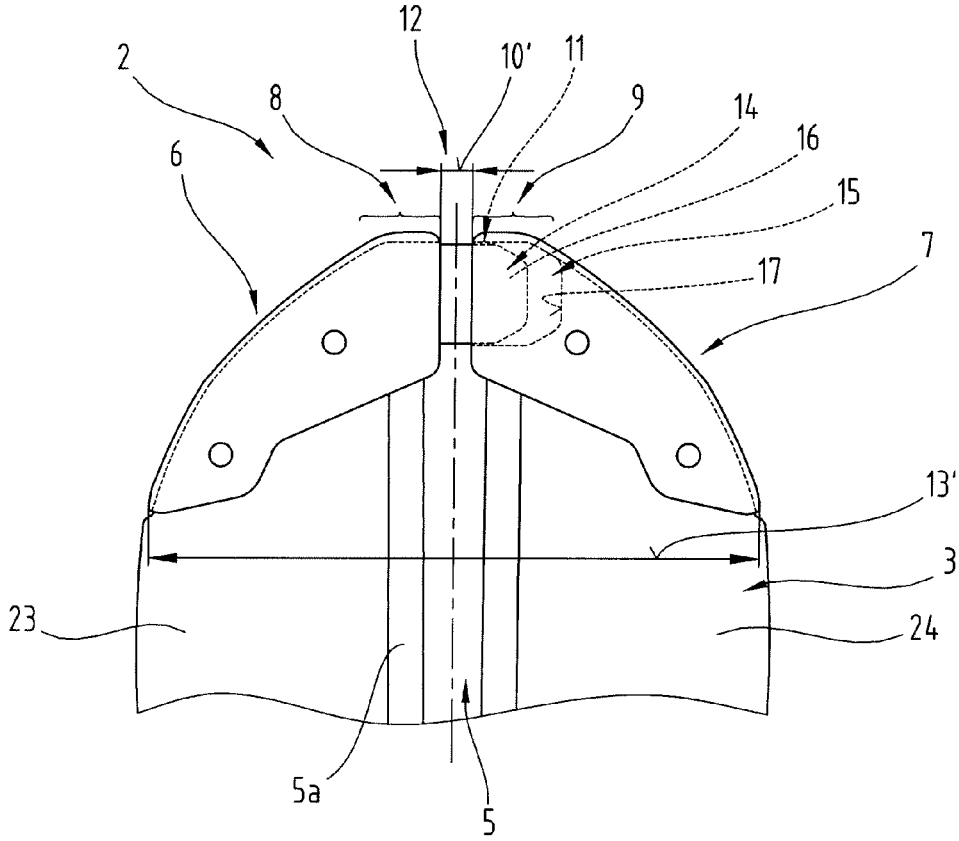
FIG. 4 shows the end piece illustrated in FIG. 3 with a wider middle portion due to a larger shovel width.

As may also be seen from the embodiment illustrated in FIGS. 3, 4, the mutually adjacent zones 8, 9 of the first and second portion 6, 7 are positioned inside the middle portion 12 by reference to a width 13 of the end pieces 2, 2'.

A guide mechanism 11 between the two portions 6, 7 is preferably provided in the middle portion 12. This guide mechanism 11 has at least two telescopically guided or at least two mutually overlapping guide elements 14, 15. The mutually co-operating guide elements 14, 15, which may be provided in the form of a guide pin and co-operating guide groove or a guide projection 16 and guide recess 17, are designed and oriented so that the end piece 2, 2', in particular its middle portion 12, can be laterally widened and re-set, i.e. made bigger and smaller, so that the width 13 of the end pieces 2, 2' is variable depending on the varying width of the gliding board body 3. By preference, this variation in the width of the end pieces 2, 2', which occurs during travel with the ski 1 or snowboard and/or can be individually pre-set, takes place starting from the tip region or from the central portion of the end pieces 2, 2'.

Instead of the linear guide mechanism 11 between the portions 6, 7 described above, another option would be for at least the middle portion 12 of the end pieces 2, 2' to be made from an elastomeric plastic 18, in particular a soft plastic or rubber. This would also enable the width 13 of the end pieces 2, 2' to be varied depending on a prized-open angle of the end portion of the gliding board body 3. An elastic middle portion 12 of this type made from an elastomeric plastic 18 is illustrated in the diagram shown in FIG. 7. The end piece 2, 2' may also be provided in the form of an integral component produced by a plastic injection molding process, in which case production and tool costs can be kept low and assembly and warehousing costs can be reduced.

As also best illustrated by the embodiment shown in FIG. 7, the middle portion 12 may be made from an elastomeric, flexible plastic 18, and the first and second portion 6, 7 respectively secured or formed on oppositely lying peripheral portions of the middle portion 12 as side parts 19, 20. In particular, the side portions 6, 7 may be molded on or jointly molded in a multi-component plastic injection molding process. These side parts 19, molded integrally on the elastomeric middle portion 12 or jointly with the elastomeric middle portion 12 are made from a relatively hard material, in particular hard plastic, or a metal material.

The middle portion 12 of the end pieces 2, 2' may therefore be provided in the form of an elastic stretchable portion 21, and this stretchable portion 21 imparts to the end pieces 2, 2' the ability to stretch and rebound due to the shape and/or material. This shape-based and/or material-based stretchable portion 21 may be provided in the form of an expandable folded arrangement 22 with at least one elastically stretching fold, as illustrated by way of example in FIG. 11.

Especially if it is to be used on the front end of a ski 1 or snowboard, the end piece 2, 2' is essentially arch-shaped or sickle-shaped as seen from above, as may be seen from the embodiments illustrated as examples in FIGS. 3 to 7 and 12 to 15. This enables savings on the material used for the end piece 2, 2' to be made but above all savings on the weight of the gliding board body 3. Alternatively, it would also be possible to opt for other geometric contours for the end pieces 2, 2', for example trapezoidal or triangular contours, as may be seen from the embodiments illustrated as examples in FIGS. 8 to 11.

FIGS. 3 to 9 and 12 to 15 illustrate different end pieces 2 provided as a cladding element for the front terminal end, in particular for the front end portion, of a ski or snowboard. In other words, these end pieces 2 are designed for the tip or shovel of a ski or snowboard. Accordingly, these end pieces 2 are provided with a view to connecting them permanently or constantly to the front end portion of the ski or snowboard and are therefore connected to the end portion of the gliding board body 3 so that they can not be detached. Positive connections and/or screw connections and/or bonded joints may be used for this purpose. Alternatively, another option is to partially integrate the end pieces 2 in the structure of the gliding board body 6 during the process of producing the gliding board body 3, in particular during the hot pressing process, or join them to the latter.

Figure 10:
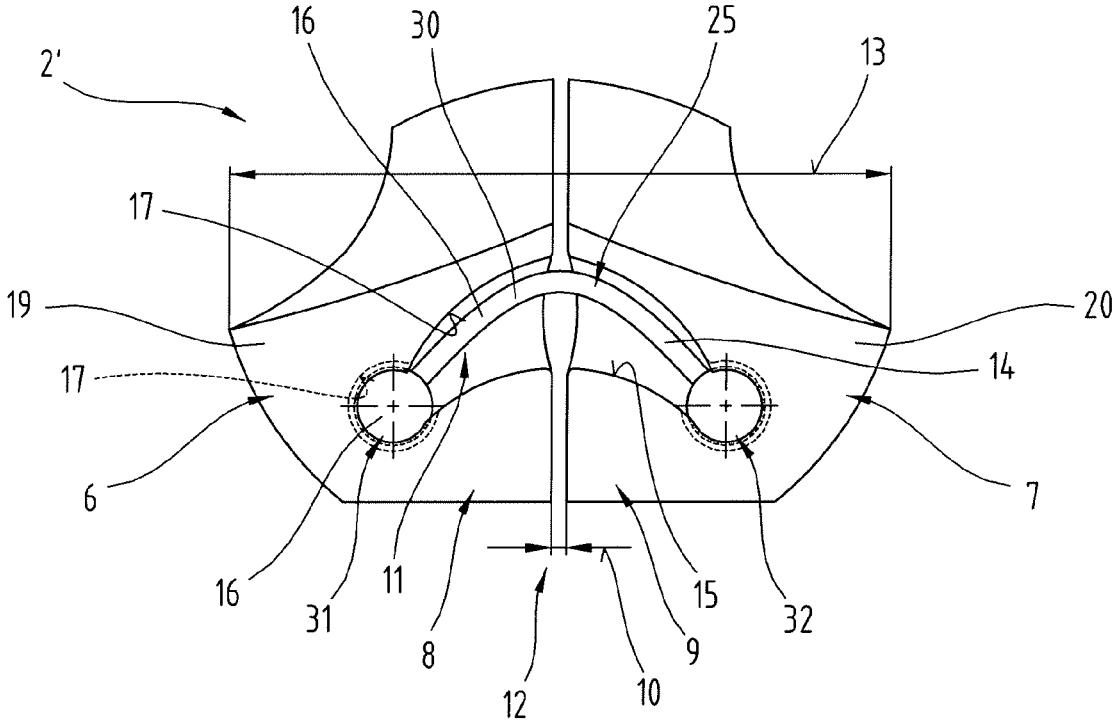
FIG. 10 shows an example of an embodiment of an end piece for the rear end of a gliding board body with an elastic bridging element between the side portions of the end pieces.
Figure 11:
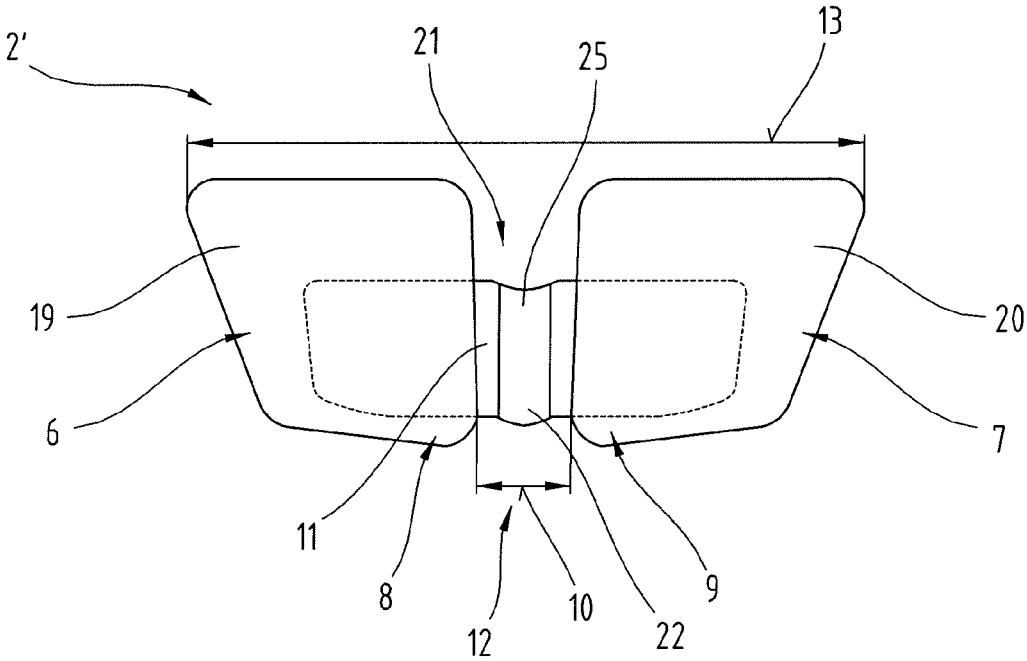
FIG. 11 is a schematic plan view illustrating an example of another embodiment of an end piece for the rear end of a gliding board body.

FIGS. 10, 11 illustrate examples of end pieces 2' which are designed as a cladding element for a terminal rear end of a ski or snowboard. These end pieces 2' or cladding elements for the rear termination of the ski or snowboard are also permanently or durably joined to the rear end portion of the ski or snowboard. Again, positive connecting mechanisms and/or screw fixing means and/or adhesive may be used for this purpose and these end pieces 2' may also be partially integrated in the gliding board body 3 during the manufacturing process.

The two side portions 6, 7 of the end pieces 2, 2' are permanently joined to a left and right gliding board tongue 23, 24 respectively 23', 24' of a gliding board body 3. The left and right gliding board tongue 23, 24 respectively 23', 24' of the gliding board body 3 is formed by at least one slot or gap 5, 5' in the gliding board body 3, which extends essentially parallel with its longitudinal mid-axis and at least partially splits the top face of the gliding board body 3 or provides an at least partial slot in the gliding board body 3, as may best be seen from FIGS. 1 to 2*a*. The left and right gliding board tongues 23, 24 respectively 23', 24' are therefore defined by the at least one cut or gap 5, 5', which preferably extends through the longitudinal mid-plane. In particular, the first portion 6 of the end pieces 2, 2' is designed to be permanently secured to a gliding board tongue 23, 23' lying to the left of the longitudinal mid-axis of a ski or snowboard and the second portion 7 of the end pieces 2, 2' is designed to be permanently secured to a gliding board tongue 24, 24' lying to the right of the longitudinal mid-axis of the ski or snowboard.

As may be seen from the embodiments illustrated in FIGS. 5 to 13, the first and second portions 6, 7 of the end pieces 2, 2' are joined to one another or elastically coupled with one another by means of at least one elastically stretchable and rebounding bridging element 25. This coupling between the first and second portion 6, 7 is designed so that the distance 10, 10' or relative spacing between the first and second portion 6, 7 is variable against the force of the bridging element 25, in particular can be made bigger. The force of the bridging element 25 is therefore dimensioned so that a change, in particular an increase in size, can still be imparted to the opening angle between the mutually adjacent gliding board tongues 23, 24 respectively 23', 24' by means of the geometry-influencing means 4—see FIG. 1, 2.

The bridging element 25, which may be either a separate component or an integral element on the side portions 6, 7, is designed so that it is capable of withstanding an elastic extension and rebound amounting to up to 15 mm without being damaged. In particular, the bridging element 25 should be able to overcome an adjustment path of up to 15 mm even after many, in particular hundreds of motion cycles without being damaged. An adjustment path of the elastic bridging element 25 and guide mechanism 11 and/or the elastic stretchable portion 21 is 0 mm to 10 mm, in particular 0 mm to 5 mm, as a rule.

Figure 5:
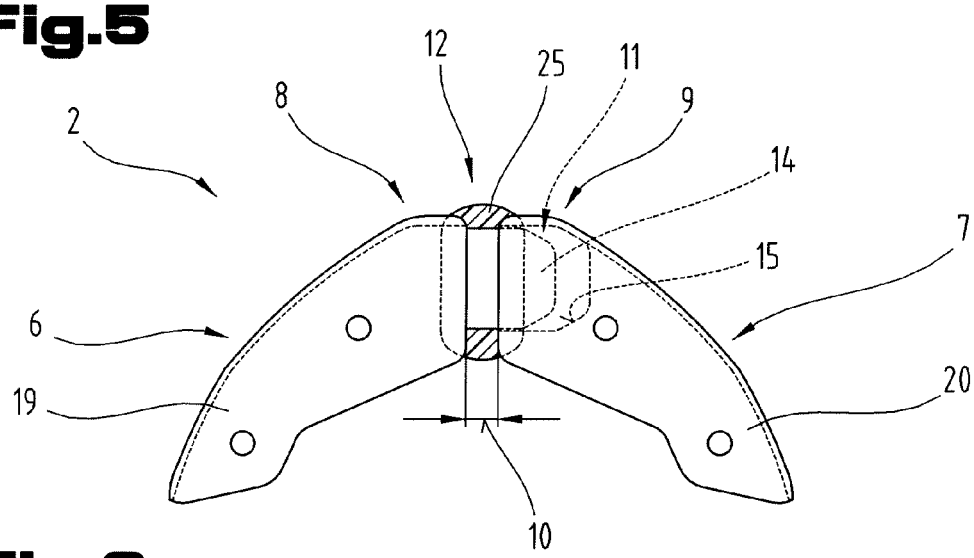
FIG. 5 illustrates another embodiment of an end piece proposed by the invention.

In the case of the embodiment illustrated as an example in FIG. 5, the elastically stretchable and rebounding bridging element 25 is structurally combined with a guide mechanism 11. The force of this elastic bridging element 25 is such that it exerts an elastically flexible resistance opposing an increase in the distance 10 and assists a resilient elastic rebounding action of the portions 6, 7 into a initial or non-operating state as soon as the forces imparting a tendency to increase the distance 10 cease. In the embodiment illustrated as an example illustrated in FIG. 5, the elastically stretchable and rebounding bridging element is injection molded onto the portions 6, 7, in particular within their zones 8, 9, and is therefore positively and non-positively joined to the first and second portion 6, 7.

Figure 6:
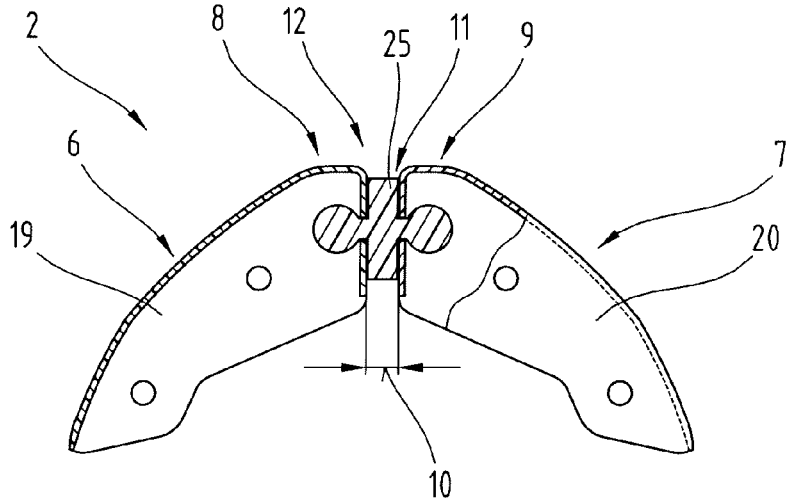
FIG. 6 illustrates another embodiment of an end piece proposed by the invention.

In the case of the embodiment illustrated in FIG. 6, the elastically stretchable and rebounding bridging element 25 is coupled with the first and second portion 6, 7 by means of positive connections. Accordingly, the bridging element 25 may also function as an elastic buffer element, which damps movements towards one another or vibrations in the direction of movement towards one another and/or in the direction of movement away from one another of the first and second portion 6, 7. The elastically stretchable and rebounding bridging element 25 is designed as a structurally separate element which can be fitted as and when required or interchangeably coupled with the portions 6, 7 as and when required. In this respect, the elastic bridging element 25 may act as a resiliently elastic tensing element, which constantly biases the portions 6, 7 in the direction in which the distance 10 or gap 5, 5' in the gliding board body 3 is made smaller—FIG. 2*a*.

Figure 8:
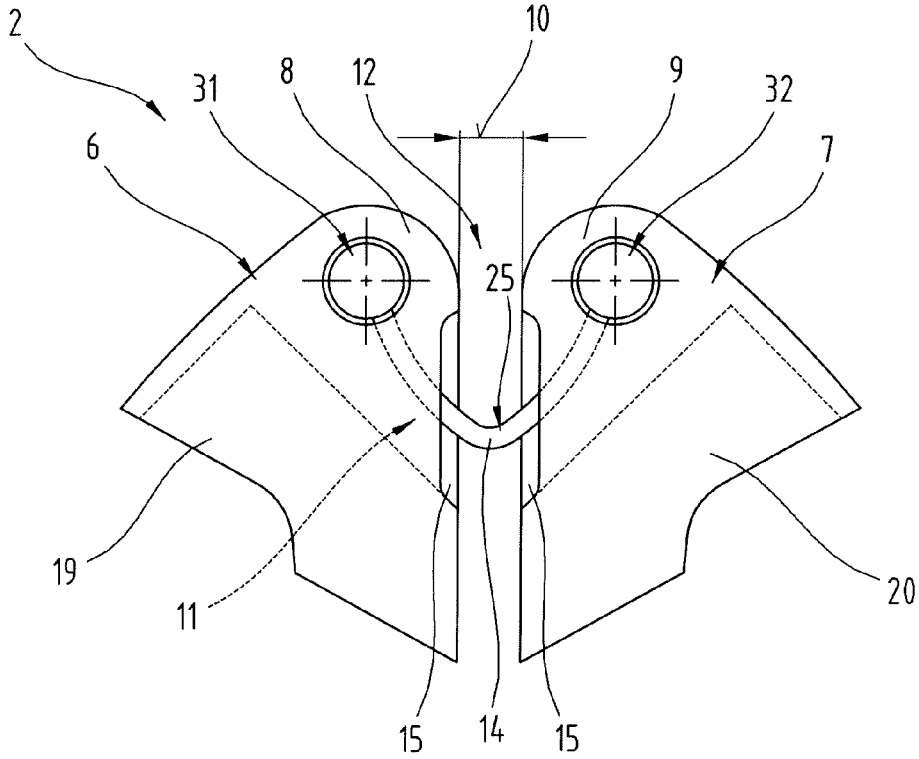
FIG. 8 illustrates an embodiment of a multi-part end piece with an arcuately extending bridging or spring element.
Figure 9:
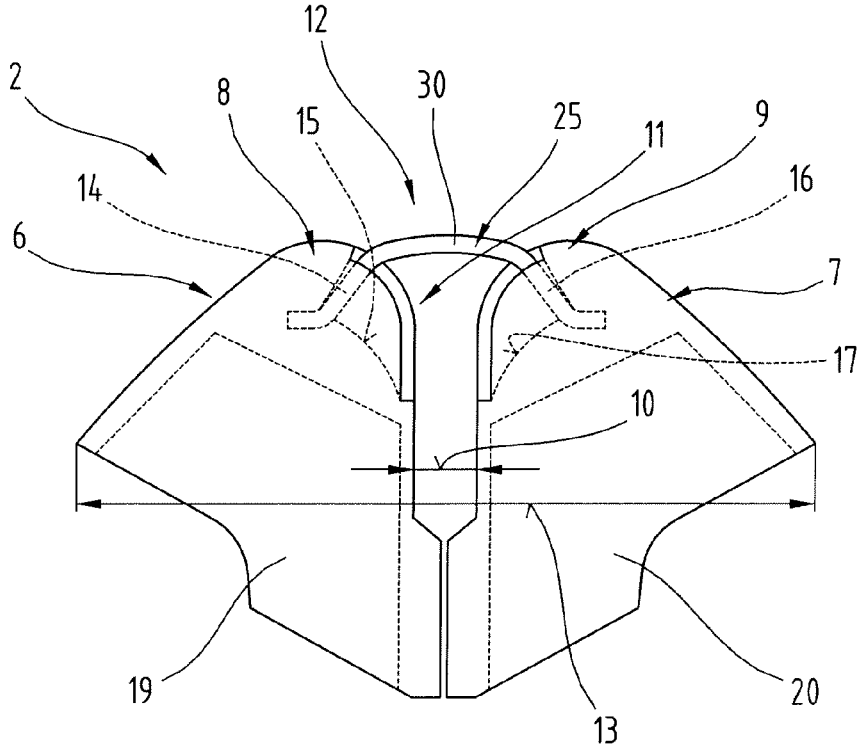
FIG. 9 illustrates another embodiment of an end piece for the front end of a gliding board body with an elastic bridging element between the side portions of the end pieces.

In the case of the embodiment illustrated in FIGS. 8 to 10, an arch-shaped or bracket-shaped bridging element 25 is provided. This bracket-shaped bridging element 25 and the co-operating spring element 30 is pivotably or articulatingly connected by its end portions to the first portion 6 on the one hand and to the second portion 7 on the other hand by pivot bearings 31, 32. A pivot or joint axis of these pivot bearings 31, 32 extends essentially perpendicular to the top and bottom face of the end pieces 2, 2'. The pivot bearing 31, 32 may be provided in the form of a bolt and bush bearing or as a ball and pan bearing, as schematically indicated in FIGS. 8, 10. In particular, cylindrical or spherical bearing elements are provided on the end portions of the arch-shaped bridging element 25, which are mounted so that they are able to pivot in co-operating guide recesses within the first and second portion 6, 7.

Instead of a pivot bearing 31, 32 of this type, it would also be possible for the elastically stretchable and rebounding bridging element 25 to be joined to the side portions 6, 7 via elastic deformation zones, as best illustrated in FIG. 9. In particular, the end portions of the arch-shaped bridging element 25 are rigidly connected to the portions 6, 7 and the end portions of the bridging element 25, which may be made from spring steel for example, constitute the elastic deformation zones.

In the embodiments illustrated, the bridging element 25 or guide mechanism 11 or middle portion 12 extends either in a straight line or in an arc across a gap or across the region between the portions 6, 7, as a result of which these components also afford reliable mechanical protection for an elastic bridging element 5*a* which may optionally be disposed inside a gap 5, 5' in the gliding board body 3, as may best be seen from FIGS. 1 to 2*a*. The end piece 2, 2', in particular its bridging element 25 and/or its guide mechanism 11 or middle portion 12 between the side portions 6, 7 therefore also acts as a mechanical protection against damage to the relatively fragile, elastic or flexible bridging element 5*a* for the gap 5, 5' in the gliding board body 3. This is of particular advantage if the gliding board body 3 encounters an obstruction with one of its ends, in particular with the shovel or tip, for example if it hits a clump of ice, a post, a ski stick, a gate bar or similar. The described end pieces 2, 2' therefore also contribute significantly to increasing the robustness of the gliding board body 3, in particular a ski 1 or snowboard with a variable geometry or size.

The essential aspect is that the bridging elements 25 illustrated in FIGS. 6 to 11 also serve as a guide mechanism 11 or stabilizing element. In particular, these bridging elements 25 prevent relative movement or vertical shifting between two adjacent gliding board tongues 23, 24 respectively 23', 24' in the direction perpendicular to the gliding face or bottom face of the gliding board body 3 and such deviating movements are counteracted by increased mechanical resistance, as may be seen particularly clearly from the diagrams shown in FIGS. 1 to 2*a*. This being the case, the guide mechanism 11 may also be provided with the bridging element 25, in particular by means of the arch-shaped spring element 30, as may be seen from the embodiments illustrated in FIGS. 8 to 10. Accordingly, part-portions of the arch-shaped bridging element 25 form the guide projections 16, which cooperate with guide recesses 17 in the first and second portion 6, 7 in order to form a mutual guide mechanism 11. As may be seen in particular from FIGS. 8 to 10, part-portions of the arch-shaped, elastically deformable bridging element 25 constitute at least a first guide element 14, which co-operates with at least one other guide element 15 in or on the second portion 6, 7 in order to form a mutual guide mechanism 11 between the first and second portion 6, 7 of the end pieces 2, 2'.

As may best be seen from FIG. 11, the elastically stretchable and rebounding bridging element 25 may also be made from flat steel with at least one expandable folded arrangement 22. The end portions of this metallic, plate-type or strip-type bridging element 25 are preferably injected into the portions 6, 7 made from plastic and thus anchored in them.

Figure 12:
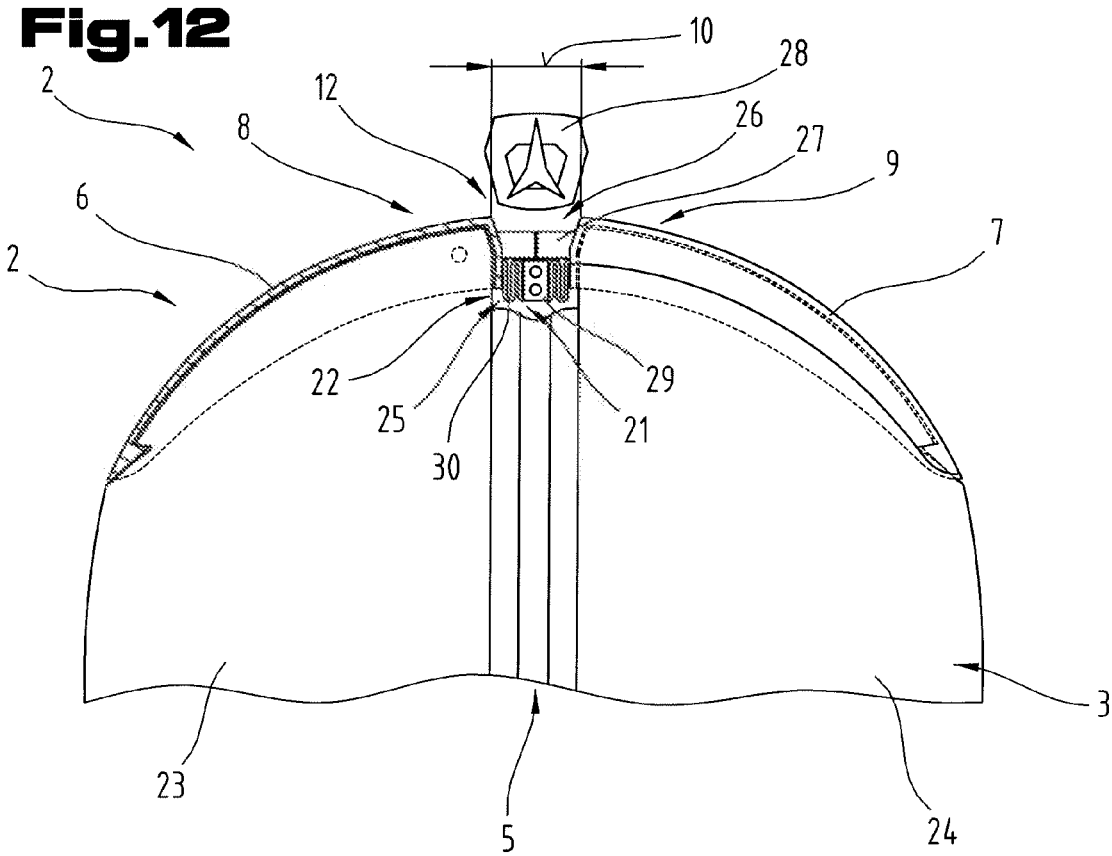
FIG. 12 is a schematic plan view illustrating an example of another embodiment of an end piece for the front end of a gliding board body with the middle part removed.
Figure 13:
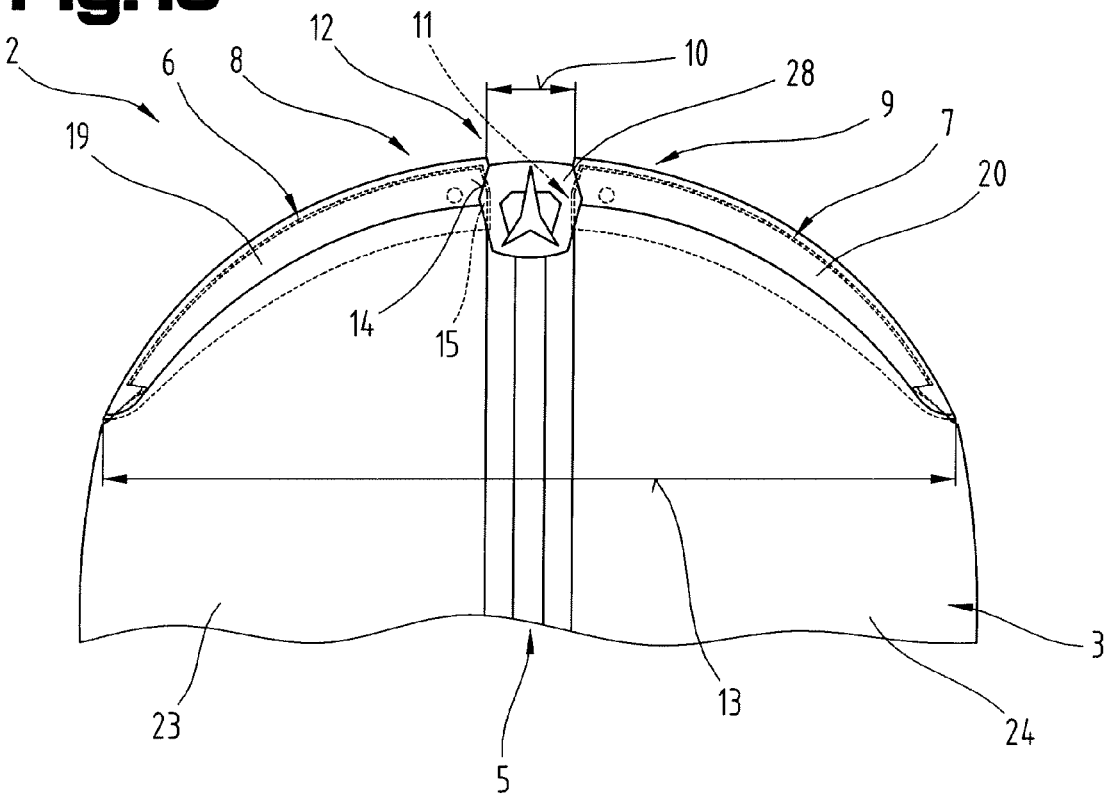
FIG. 13 shows the end piece illustrated in FIG. 12 with the middle part fitted or mounted between the side portions of the end pieces.

As may be seen from the embodiment illustrated in FIGS. 12, 13, at least one stop element 26 may be provided between the first and second portion 6, 7 of the end pieces 2 in order to fix a minimum relative distance or a minimum distance 10 between the first and second portion 6, 7. This at least one stop element 26 may be provided in the form of at least one projection 27 disposed between the mutually facing or adjacent zones 8, 9 of the first and second portion 6, 7. This stop element 26 is dimensioned so that an elastically stretchable and rebounding bridging element 25 between the first portion 6 and the second portion 7 is in a largely non-operating or initial state when the stop element 26 is active.

A width of the elastically stretchable and rebounding bridging element 25 is preferably less than half the total width 13 of the end piece 2.

As may also be seen from the embodiment illustrated in FIGS. 12, 13, a middle part 28 may also be disposed or retained on the elastically stretchable and rebounding bridging element 25. It is preferable if this middle part 28 can be positively connected to the elastically stretchable and rebounding bridging element 25. In this respect, the middle part 28 is preferably connected to the elastically stretchable and rebounding bridging element 25 in its middle portion.

As may be seen from the embodiment illustrated as an example, the middle portion of the elastically stretchable and rebounding bridging element 25 may have a block-type support element 29 for retaining or accommodating the middle part 28.

The elastically stretchable and rebounding bridging element 25 may comprise a spring element 30 extending in a meandering shape, as may be seen from FIG. 12 for example. As illustrated in FIGS. 8 to 10, the spring element 30 may also be arch-shaped.

The co-operating spring elements 30 may be made from plastic, from spring steel or from some other material with adequate elastic properties.

In addition to the design based on a separate stop element 26, another option is for the elastically stretchable and rebounding bridging element 25 to serve as a stop element in order to limit the minimum distance 10 between the first and second portion 6, 7, as may be seen in the embodiment illustrated as an example in FIGS. 5, 6.

As in the case of the embodiment illustrated in FIGS. 12, 13, the middle part 28 may also be designed so that it positively engages by its lateral peripheral portions in the mutually facing terminal ends of the first and second portion 6, 7 or the middle part 28 bridges the mutually facing terminal ends of the portions 6, 7 with a lateral overlap, as may best be seen from FIG. 13.

The essential aspect of the described end pieces 2, 2' is that the first and second portion 6, 7 move into one another in a mutually and telescopically guided arrangement and/or are elastically coupled with one another so that the width of the U-shaped sickle-shaped end pieces 2, 2' is variable starting from the central apex point or starting from its middle portion 12. In this respect, it is of practical advantage if a guide mechanism 11 is provided between the first and second portion 6, 7, which enables a relative displacement between the first and second portion 6, 7 in a direction extending parallel with the gliding or standing plane and transversely to the longitudinal direction of a ski or snowboard. The guide mechanism 11 between the first and second portion 6, 7 may be provided in the form of a groove-spring connection or in the form of a groove-spring-groove connection. This guide mechanism 11 is also designed so that relative displacements between the first and second portion 6, 7 of the end pieces 2, 2' are prevented in the direction perpendicular to the bottom face or gliding face of a ski or snowboard. In particular, the end piece 2, 2' prevents or reduces relative movements or shifting between the gliding board tongues 23, 24 respectively 23' 24' in the direction perpendicular to the bottom and top face of the gliding board body 3, as may be seen in particular from the diagrams shown in FIGS. 1 to 2*a*.

The end piece 2, 2' therefore acts as a load- or force-transmitting coupling between the two gliding board tongues 23, 24 respectively 23', 24', thereby enabling the stability and bending behavior of the respective end portion of the gliding board body 3 to be positively influenced. With the specified end pieces 2, 2', therefore, the performance of a gliding board body 3 with a variable geometry or size can be further enhanced. In particular, improved cornering behavior and a more exact controllability of the gliding board body 3, in particular the ski or snowboard, can be achieved by means of the specified end pieces 2, 2'.

It is of advantage if at least the front end piece 2, in particular its first and second portion 6, 7, is of an essentially U-shaped or L-shaped cross-section. This results in a good hold of the end pieces 2 in the respective end portion of the gliding board body 3. This shape also provides a cladding or cover for the front end face or the rear end face of the gliding board body 3. In particular, the end piece 2 can be push-fitted or clinched round the terminal end of the gliding board body 3, thereby enabling it to be fitted during the process of manufacturing the gliding board body 3 or ski 1 or snowboard so that it is as strong as possible and particularly resistant to tearing off.

Figure 14:
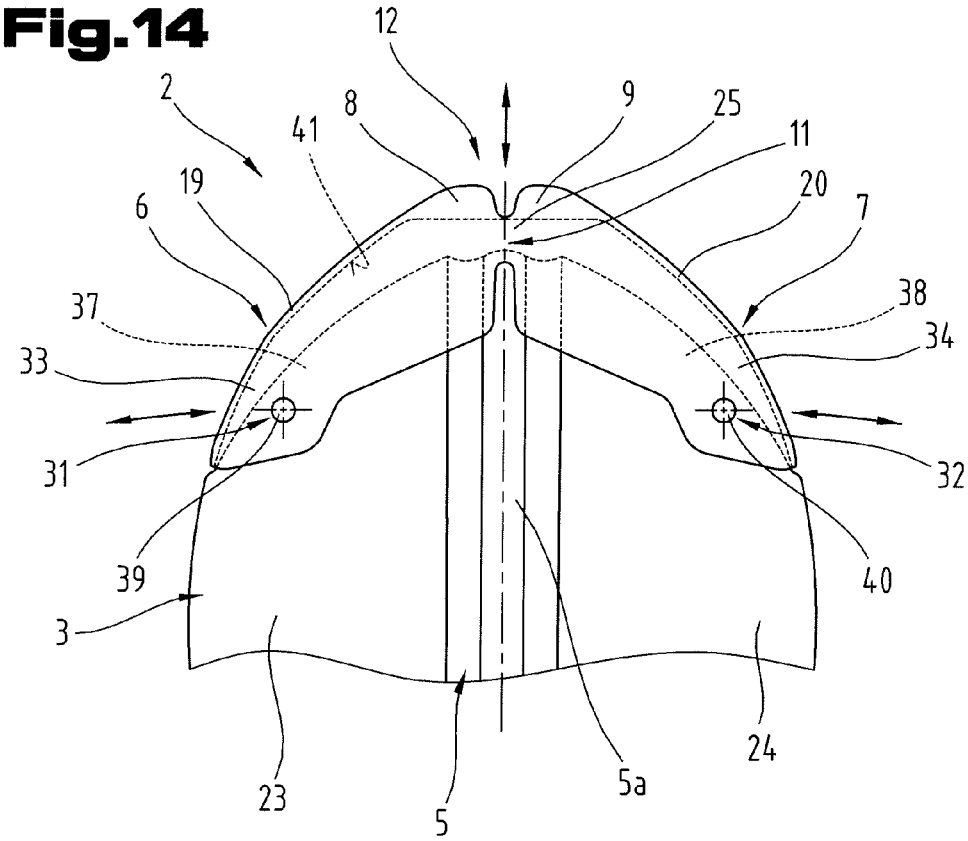
FIG. 14 illustrates a hinge-mounted end piece with an elastically deformable middle portion.
Figure 15:
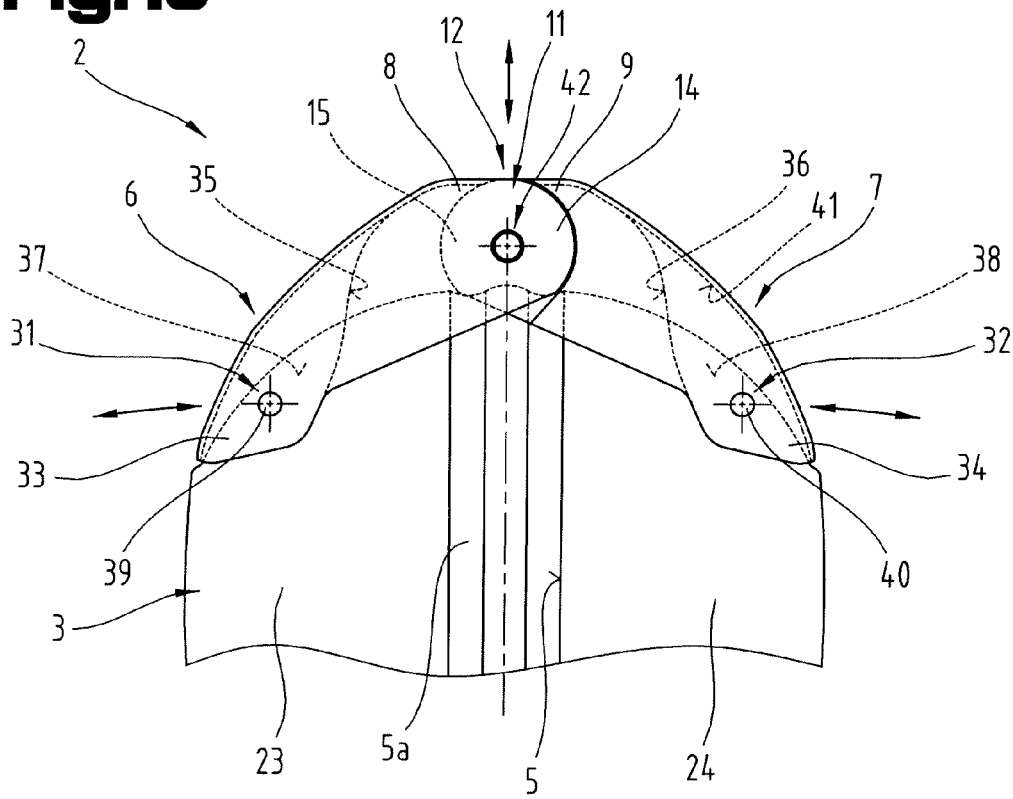
FIG. 15 illustrates a hinge-mounted end piece with a hinge-mounted middle portion.

FIGS. 14, 15 illustrate another embodiment of a front end piece 2, although an end piece of this type could naturally also be used on the rear end portion of a gliding board body 3. In the case of the embodiment illustrated in FIG. 14, the first and second portions 6, 7 are coupled with one another in the mutually facing zones 8, 9 to form a single piece. In other words, the portions 6, 7 merge with one another in the middle portion 12 of the end pieces 2 to form a single part. In particular, the two side portions 6, 7 are connected to one another by means of an elastic bridging element 25 or via an elastic middle portion 12. The middle portion 12 may be designed in the form of an integral hinge arrangement, in which case an articulated or living hinge connection made from an appropriately selected material and/or shape for the middle portion 12 can be provided between the portions 6, 7.

The elastically deformable middle portion 12 is preferably designed so that it affords as low as possible a resistance to the variations in the width of the gliding board body 3 which occur during travel and/or are induced as a result of individual initial settings.

The elastically deformable middle portion 12 in the embodiment illustrated in FIG. 14 is disposed in the mutually adjacent zones 8, 9 of the first and second portion 6, 7. In zones 33, 34 of the first and second portion 6, 7 remote from these adjacent zones 8, 9, the first and second portion 6, 7 of the end pieces 2 can be respectively articulatingly connected to the side edges 37, 38 of a ski or snowboard lying opposite one another, in particular its gliding board tongues 23, 24. In the case of the embodiment illustrated in FIG. 14, the articulated connection between the outer or distal zones 33, 34 and the respective gliding board tongues 23, 24 is provided in the form of bolt-type fixing means 39, 40, in particular screws or rivets. Via these fixing means 39, 40, the outer zones 33, 34 of the first and second portion 6, 7 are each articulatingly connected to the gliding board tongues 23, 24. This results in a triangular arrangement, and the corner points on the base of this triangular arrangement are defined by the articulated connection established via die fixing means 39, 40. The articulated connection at the apex of this triangular arrangement, on the other hand, is the elastically deformable middle portion 12. The fixing means 39, 40 positioned at the outer end portions for the first and second portion 6, 7 therefore also form pivot bearings 31, 32 between the outer zones 33, 34 of the portions 6, 7 and the respective co-operating gliding board tongues 23, 24.

A distance or a gap 41 between the terminal end of the gliding board body 3 and the terminal end internal wall or front boundary wall of the end pieces 2 permits a relative displaceability between the end piece 2 and the end portion of the gliding board body 3. This gap 41 or this freedom of movement is primarily necessary when the width of the gliding board body 3 is made bigger or smaller. Particularly during lateral alternating movements of gliding board tongues 23, 24 relative to the longitudinal mid-axis of the gliding board body 3, this results in a front bearing or rear bearing of the tip and middle portion 12 by reference to the direction of travel of the gliding board body 3, as symbolized by the double arrows.

In the embodiment illustrated in FIG. 15, the mutually adjacent zones 8, 9 of the portions 6, 7 may be connected to one another by means of an articulated joint 42 instead of an elastically stretchable and rebounding bridging element 25. To this end, the first and second portion 6, 7 overlap and these two portions 6, 7 provide the articulation for the middle portion 12 in their overlap zone. Again in this embodiment, a triangular arrangement is obtained, the base distance of which between the outer zones 33, 34 can be varied in length and the legs of which are formed by the portions 6, 7. A vertical dimension perpendicular to the base of this triangular arrangement is therefore variable, depending on the changes in the width of the gliding board body 3. By means of the articulated joint 42, the middle portion 12 and zones 8, 9 are able to effect relative movements in the longitudinal direction of the gliding board body 3. Alternatively to or in combination with pivot bearings 31, 32 between the outer zones 33, 34 and gliding board tongues 23, 24, it would also be possible to provide at least one elastic deformation zone 35, 36 in or on the side portions 6, 7, as schematically indicated in FIG. 15.

The embodiments illustrated as examples represent possible variants of end pieces 2, 2' and skis 1, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the end pieces 2, 2' and the skis 1, they and their constituent parts are illustrated to a certain extent out of scale and/or on an enlarged scale and/or on a reduced scale. The objective underlying the independent inventive solutions may be found in the description.

Above all, the individual embodiments of the subject matter illustrated in FIGS. 1-2*a*; 3, 4; 5; 6; 7; 8; 9; 10; 11; 12, 13; 14; 15 constitute independent solutions proposed by the invention in their own right. The objectives and associated solutions proposed by the invention may be found in the detailed descriptions of these drawings.

LIST OF REFERENCE NUMBERS

1 Ski
2,2' End piece
3 Gliding body
3*a* Binding mechanism
4 Geometry-influencing means
5,5' Gap
5*a* Flexible bridging element
6 Portion (first)
7 Portion (second)
8 Zone (adjacent)
9 Zone (adjacent)
10,10' Distance
11 Guide mechanism
12 Middle portion
13 Width
14 Guide element
15 Guide element
16 Guide projection
17 Guide recess
18 Elastomeric plastic
19 Side part
20 Side part
21 Stretchable portion
22 Expandable folded arrangement
23,23' Gliding board tongue
24,24' Gliding board tongue
25 Bridging element
26 Stop element
27 Projection
28 Middle part
29 Support element
30 Spring element
31 Pivot bearing
32 Pivot bearing
33 Zone (remote)
34 Zone (remote)
35 Deformation zone
36 Deformation zone
37 Side edge
38 Side edge
39 Fixing means
40 Fixing means
41 Gap
42 Articulated joint

The invention claimed is:

1. An end piece for cladding a terminal front or rear end of a ski or snowboard, the ski or snowboard having a longitudinal axis and a first gliding board tongue on one side of the longitudinal axis and a second gliding board tongue on the other side of the longitudinal axis, wherein the end piece is adapted to be rigidly and non-detachably fitted onto a front or rear end portion of the ski or snowboard, and wherein the end piece has a substantially arch-shaped or sickle-shaped profile along a gliding plane of the ski or snowboard, the end piece comprising at least a first portion adapted to be secured to the first gliding board tongue and a second portion adapted to be secured to the second gliding board tongue, the first portion having a zone lying adjacent to the second portion and the second portion having a zone lying adjacent to the first portion, wherein a position of the first portion is variable relative to a position of the second portion, and wherein a distance between the mutually adjacent zones or a width or length dimension of at least one of the zones can be varied.

2. The end piece according to claim 1, wherein the end piece has a width and a middle portion substantially centrally located across the width, wherein the end piece is designed so that its width can be varied by adjustment of its middle portion.

3. The end piece according to claim 1, wherein the end piece is designed so that the distance between the mutually adjacent zones can be varied depending on a load-induced varying width and/or an individually pre-settable width of the front and rear ends of the ski or snowboard.

4. The end piece according to claim 1, wherein the end piece has a width and a middle portion substantially centrally located across the width, and wherein the mutually adjacent zones of the first and second portion are positioned in the middle portion.

5. The end piece according to claim 1, wherein the end piece has a width and a middle portion substantially centrally located across the width, and wherein a guide mechanism is provided in the middle portion, the guide mechanism including at least two telescopically guided or mutually overlapping guide elements, so that the end piece can be made wider and narrower by adjustment of the guide mechanism.

6. The end piece according to claim 1, wherein the end piece has a width and a middle portion substantially centrally located across the width, and wherein at least one elastically stretchable and rebounding zone is provided in at least the middle portion.

7. The end piece according to claim 6, wherein the middle portion is made from elastomeric plastic.

8. The end piece according to claim 1, wherein the end piece is designed as a single-piece component produced by a plastic injection molding process.

9. The end piece according to claim 1, wherein the end piece has a width and a middle portion substantially centrally located across the width, and wherein the middle portion is made from an elastomeric, flexible plastic, and wherein the first and second portion are respectively secured to or formed on mutually opposite peripheral portions of the middle portion forming side parts made from a relatively hard material.

10. The end piece according to claim 9, wherein the end piece is made as an integral component in a multi-component plastic injection molding process.

11. The end piece according to claim 1, wherein the end piece has a width and a middle portion substantially centrally located across the width, and wherein the middle portion is designed as a stretchable portion with an ability to stretch and rebound due to the shape and/or material.

12. The end piece according to claim 1, wherein the first and second portion are connected to one another by means of at least one elastically stretchable and rebounding bridging element so that the distance or relative distance between the first and second portion can be varied against the force of the bridging element.

13. The end piece according to claim 12, wherein the bridging element is designed so that it is capable of withstanding a one hundredfold extension and rebound to a degree of up to 15 mm without being damaged.

14. The end piece according to claim 1, wherein at least one stop element is provided between the first and second portion for fixing a minimum distance or a non-operating position between the first and second portion.

15. The end piece according to claim 14, wherein the stop element is provided in the form of at least one projection which is disposed within the mutually adjacent zones of the first and second portion.

16. The end piece according to claim 14, wherein the stop element is dimensioned so that an elastically stretchable and rebounding bridging element between the first portion and second portion is in a largely non-stretched or initial state when the stop element is active.

17. The end piece according to claim 12, wherein an extension of the elastically stretchable and rebounding bridging element measured parallel with an adjustment path or a variability in distance between the first and second portion is less than half a width of the end piece.

18. The end piece according to claim 12, wherein a middle part is retained on the elastically stretchable and rebounding bridging element.

19. The end piece according to claim 18, wherein the middle part can be positively connected to the elastically stretchable and rebounding bridging element.

20. The end piece according to claim 18, wherein the middle part can be connected to the elastically stretchable and rebounding bridging element in a middle portion thereof.

21. The end piece according to claim 20, wherein the middle portion of the elastically stretchable and rebounding bridging element has a block-type support element for retaining or accommodating the middle part.

22. The end piece according to claim 18, wherein the middle part has lateral peripheral portions, wherein the first and second portion have mutually facing terminal ends in the mutually adjacent zones, and wherein the lateral peripheral portions of the middle part positively engage the mutually facing terminal ends bridge the mutually facing terminal ends with a lateral overlap.

23. The end piece according to claim 12, wherein the elastically stretchable and rebounding bridging element comprises at least one arch-shaped or meandering spring element.

24. The end piece according to claim 23, wherein the spring element is made from plastic.

25. The end piece according to claim 23, wherein the spring element is made from spring steel.

26. The end piece according to claim 12, wherein the elastically stretchable and rebounding bridging element has or forms a stop element for fixing a minimum distance between the first and second portion.

27. The end piece according to claim 1, wherein the first and second portions merge into one another telescopically so that a width of the end piece can be varied in a direction extending parallel to the gliding plane and transversely to the longitudinal axis of the ski or snowboard.

28. The end piece according to claim 1, wherein a guide mechanism is provided between the first and second portions, the guide mechanism permitting relative displacement between the first and second portions in a direction extending parallel to the gliding plane and transversely to the longitudinal axis of the ski or snowboard.

29. The end piece according to claim 1, wherein the first and second portions are mutually guided one inside the other, so that relative displacements between the first and second portions in a direction perpendicular to the gliding plane of the ski or snowboard are prevented.

30. A ski or snowboard having a gliding board body for gliding on snow or ice, wherein an end piece according to claim 1 is secured to at least one end portion of the gliding board body.

31. The ski or snowboard according to claim 30, wherein the gliding board body has at least one geometry-influencing means for varying a width and/or cross-sectional geometry of the front and/or rear end portion of the gliding board body.

32. The ski or snowboard according to claim 31, wherein the geometry-influencing means comprises at least one slot or gap in the gliding board body, the slot or gap extending along a longitudinal direction of the gliding board body and running from at least one end of the gliding board body towards a middle portion of the gliding board body.

33. The ski or snowboard according to claim 32, wherein the at least one slot or gap in the gliding board body is bridged by at least one flexible bridging element.

34. The end piece according to claim 29, wherein the first and second portions are mutually guided one inside the other by means of a tongue and groove connection.

35. The end piece according to claim 7, wherein the middle portion is made from rubber.

36. The end piece according to claim 9, wherein the relatively hard material is hard plastic or metal.

37. The end piece according to claim 11, wherein the stretchable portion has an expandable folded arrangement.

38. The end piece according to claim 19, wherein the middle part can be positively connected to the elastically stretchable and rebounding bridging element by means of a plug-in connection.

* * * * *